US005996470A

United States Patent [19]

Eady et al.

[11] Patent Number: 5,996,470

[45] Date of Patent: Dec. 7, 1999

[54] WEAR RING FOR DIAPHRAGM AND OUTER PISTON

[75] Inventors: Eldon S. Eady, Greensburg; Larry J. Stephenson, Monroeville, both of Pa.

[73] Assignee: Westinghouse Air Brake Company, Wilmerding, Pa.

[21] Appl. No.: 08/972,581

[22] Filed: Nov. 18, 1997

[51] Int. Cl.[6] ..... F01B 19/00

[52] U.S. Cl. ..... 92/99; 92/103 R; 92/100

[58] Field of Search ..... 92/46, 98 R, 99, 92/100, 103 R, 103 F, 103 SD, 103 M

[56] References Cited

U.S. PATENT DOCUMENTS

| | | | |
|---|---|---|---|
| 4,887,516 | 12/1989 | Scott et al. | 92/100 X |
| 5,220,863 | 6/1993 | Scott et al. | 92/103 SD X |
| 5,291,822 | 3/1994 | Alsobrooks et al. | 92/100 X |
| 5,724,881 | 3/1998 | Reynolds | 92/103 R X |
| 5,743,169 | 4/1998 | Yamada | 92/103 SD X |

*Primary Examiner*—Hoang Nguyen

*Attorney, Agent, or Firm*—James Ray & Associates

[57] ABSTRACT

A combination pump diaphragm and outer piston arrangement used in certain pump applications in which at least a portion of such diaphragm is in contact with an outer piston which would tend to abrade the diaphragm. The combination comprises a diaphragm member which includes a generally flat portion, a generally flexure annular portion and an enlarged bead like wear ring portion disposed intermediate such generally flat portion and such generally flexure annular portion. Such bead like wear ring portion has a first predetermined diameter and a predetermined configuration. The outer periphery of such diaphragm member is secured to a pump housing. An outer piston member is disposed for securing such diaphragm member to a piston rod of a pump. Such outer piston member includes a generally flat portion contacting such generally flat portion of such diaphragm member and an arcuate portion contacting such enlarged bead like wear ring portion. The outer piston member does not extend beyond the predetermined configuration of the enlarged bead like wear ring portion of such diaphragm member.

31 Claims, 3 Drawing Sheets

WEAR RING FOR DIAPHRAGM AND OUTER PISTON

FIELD OF INVENTION

The present invention relates, in general, to pumps used in certain preselected type pumping systems and, more particularly, this invention relates to an improved diaphragm and outer piston arrangement used in such pumps in which a diaphragm and outer piston are modified so that such outer piston will contact such diaphragm at a wear ring area of the diaphragm where an excessive amount of wear is most likely to occur.

BACKGROUND OF THE INVENTION

As is generally well known in the prior art, diaphragms are an integral part of pumps. It is necessary in these applications for the diaphragms to be flexible in order for them to perform their intended function. However, the constant flexing of the diaphragm when the pump is in use creates stresses on the parts of the diaphragm that are attached to the non-flexing portions (i.e. outer piston, inner piston, pump housing) of the pump. Such outer and inner pistons are also referred to as follower and flange, respectively. Illustrated in FIG. 1 of the drawings is a typical example of a prior art arrangement of an outer piston and diaphragm used in many of these pump applications.

The inner and outer pistons contact preselected surfaces of the diaphragm and secure the diaphragm to the piston rod for reciprocal movement within the pump. These areas of the diaphragm normally exhibit rather severe wear and after extended use will eventually crack and/or have holes wear through the diaphragm. When this occurs the pump is out of commission until a new diaphragm can be installed to replace the worn out diaphragm.

In most cases the rest of the diaphragm is still in relatively good shape. Only at these wear points, under normal circumstances, does the diaphragm reveal excessive wear problems. The required replacement of the diaphragm is only one of the problems that maintenance personnel may encounter. The location of many pumps are such that they may be very difficult to get to and even after reaching the pump performing the work of replacing a diaphragm presents a challenge.

Thus, the longer a pump can be kept in operation without the need for servicing represents a considerable savings in not only the maintenance personnel's time but in the "up" time for whatever operation the pump is being used. Any improvement in either the formulation of the diaphragm or the configuration of the diaphragm and the inner and outer pistons that can increase its usable life expectancy is a welcome improvement.

The present invention is specifically related to improving the wear characteristics of a diaphragm at the aforementioned stress points related to abrasion by a outer piston.

SUMMARY OF THE INVENTION

The present invention provides a combination pump diaphragm and outer piston arrangement used in certain pump applications in which at least a predetermined portion of such diaphragm is in contact with such outer piston which would tend to abrade such diaphragm. The combination pump diaphragm and outer piston arrangement comprises a diaphragm member formed from at least one layer of a flexible material selected from a group comprising ethylene propylene diene monomers (EPDM), chloroprenes, nitrile rubbers and fluoroelastomers. Such diaphragm member includes a generally flat portion, a generally flexure annular portion and an enlarged bead like wear ring portion disposed intermediate such generally flat portion and such generally flexure annular portion. Such enlarged bead like wear ring portion has a first predetermined diameter and a predetermined configuration. The present invention further includes a means for securing such outer periphery of such diaphragm member to a pump housing. An outer piston member is disposed for securing such diaphragm member to a piston rod of a pump. Such outer piston member includes a generally flat surface portion contacting a generally flat surface of such generally flat portion of such diaphragm member and an arcuate portion contacting such enlarged bead like wear ring portion of such diaphragm member. Such outer piston member does not extend beyond such predetermined configuration of such enlarged bead like wear ring portion of such diaphragm member. There is further a central aperture in such diaphragm member and such outer piston member for attaching such combination pump diaphragm and outer piston arrangement to a piston rod of a pump.

OBJECTS OF THE INVENTION

It is, therefore, one of the primary objects of the present invention to provide an improved diaphragm and outer piston arrangement which will resist diaphragm wear at least in the outer piston area where such diaphragm is secured to a pump and is most susceptible to wear.

Additionally, it is an object of the present invention to provide a diaphragm and outer piston arrangement wherein the useful life of the diaphragm will be extended.

Another object of the present invention is to provide a diaphragm and outer piston arrangement which can be easily molded from a number of different material formulations.

Still another object of the present invention is to provide a diaphragm and outer piston arrangement which is cost effective to use by decreasing maintenance cost and improving productivity of the pumping arrangement.

In addition to the objects and advantages of the present invention which have been described with some degree of particularity above, it should be both noted and understood that a number of other important objects and advantages of the improved combination diaphragm and outer piston arrangement will become more readily apparent to those persons who are skilled in the relevant art related to pumping systems, and more particularly diaphragms, from the following more detailed description of the invention, particularly, when such detailed description is taken in conjunction with the attached drawing Figures and with the appended claims.

BRIEF DESCRIPTION OF THE PRESENTLY PREFERRED EMBODIMENT OF THE INVENTION

Figure 1:
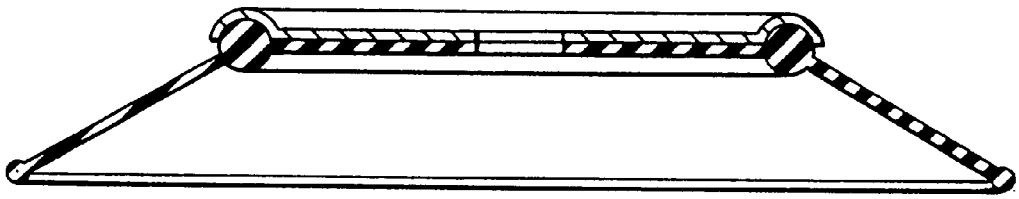
FIG. 1 PRIOR ART
FIG. 1 is a cross-sectional view of a prior art diaphragm and outer piston arrangement.

Prior to proceeding to the more detailed description of the present invention, it should be noted that for the sake of clarity in understanding the invention, identical components with identical functions have been designated with identical reference numerals throughout the drawing Figures.

Figure 2:
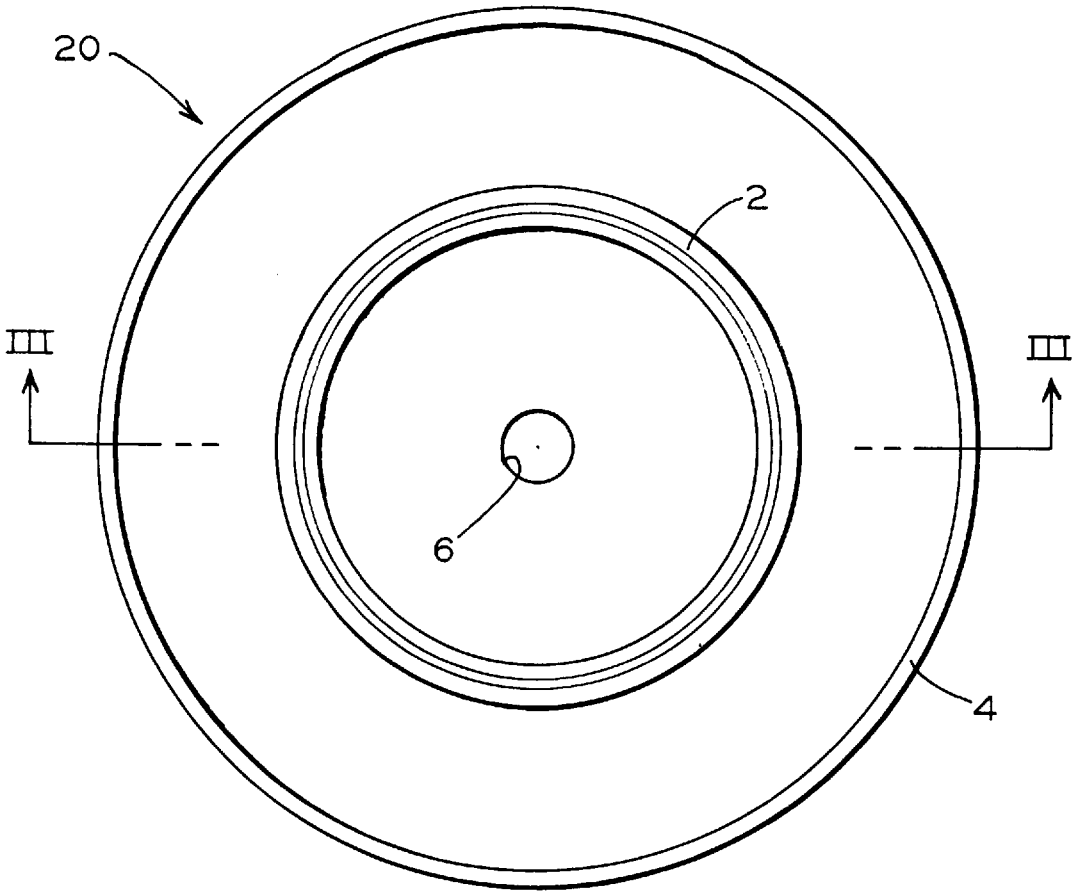
FIG. 2 is a plan view of a typical diaphragm incorporating the presently preferred embodiment of the invention.
Figure 3:
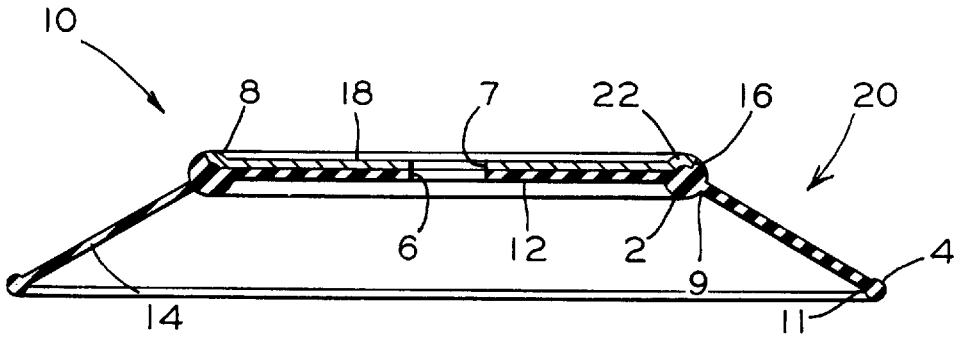
FIG. 3 is a cross-sectional view of a diaphragm taken along the lines II—II of FIG. 2 together with a outer piston in a combination pump diaphragm and outer piston arrangement.

Reference is now made, more particularly, to FIGS. 2 and 3. Illustrated therein is a presently preferred embodiment of a combination pump diaphragm and outer piston arrangement, generally designated 10. Included in such combination pump diaphragm and outer piston arrangement 10 is a diaphragm member, generally designated 20.

Such diaphragm member 20 is formed from at least one layer of a flexible material selected from a group consisting of ethylene propylene diene monomers (EPDM), Neoprene (chloroprene), nitrile rubbers, fluoroelastomers, and various mixtures thereof. In a preferred embodiment of the present invention such flexible materials are bonded around a fabric inner layer. In the presently preferred embodiment of the present invention such fabric inner layer is nylon.

Such diaphragm member 20 includes a generally flat portion 12, a generally conically shaped flexure annular portion 14, and an enlarged bead like wear ring portion 2 connected to an outer periphery of such generally flat portion 12 and to a first edge portion 9 of such generally conically shaped flexure portion 14. Such enlarged bead like wear ring portion 2 has a predetermined diameter and a predetermined configuration. In a presently preferred embodiment of the invention such configuration includes a pointed projection 16 on an outer periphery of such enlarged bead like wear ring portion 2 for engagement with such outer piston member 8.

Such diaphragm 20 further includes a means connected to a second edge portion 11 of such generally conically shaped flexure portion 14 of the diaphragm member 20 for securing such second edge portion 11 of such generally conically shaped flexure portion 14 of such diaphragm member 20 to a pump housing (not shown). In a presently preferred embodiment of the invention, such means is a bead like portion 4. Such bead like portion 4 has a predetermined diameter. Although it is presently preferred that the means for securing such diaphragm 20 to pump housing is a bead like portion 4, it is within the scope of the invention that another means may be used for securing such diaphragm member 20 to the pump housing.

Combination pump diaphragm and outer piston arrangement 10, also includes an outer piston member 8 which is engagable with such diaphragm member for securing such diaphragm member 20 to a piston rod (not shown in FIG. 3) of a pump. Such outer piston member 8 includes a generally flat portion 18 which contacts such generally flat portion 12 of diaphragm member 20, and an arcuate portion 22 which contacts enlarged bead like wear ring portion 2 of diaphragm member 20.

Combination pump diaphragm and outer piston arrangement 10, further includes a first central aperture 6 formed in such generally flat portion 12 of diaphragm member 20. Such first aperture 6 has a predetermined diameter. There is a second central aperture 7, which also has a predetermined diameter, formed in generally flat portion 18 of outer piston member 8. Such central aperture 7 of outer piston member 8 is substantially aligned with first central aperture 6 of diaphragm member 20 for attaching combination pump diaphragm and outer piston arrangement 10 to a piston rod of a pump. In the presently preferred embodiment of the invention the predetermined diameter of such central aperture 6 formed in such generally flat portion 12 of diaphragm member 20 and such central aperture 7 of outer piston member 8 are substantially the same.

Thus, it can be seen that when diaphragm 20 flexes, the wear point on diaphragm member 20 is not on the generally flexure annular portion 14 as it was on prior art type diaphragms and outer pistons. With the present invention such wear area is now on the enlarged bead like wear ring 2. This portion of such diaphragm member 20 is larger than the flexure annular portion 14 and can resist the abrasive effects of the rubbing of diaphragm member 20 on outer piston member 8 for a considerably longer period of time than with the prior art arrangements. In laboratory tests with the present invention of such diaphragm and outer piston arrangement 10, diaphragms lasted three times as long as they did with such prior art arrangements. The combination pump diaphragm and outer piston arrangement 10 can replace the present outer piston whenever a new diaphragm is needed so that no or only very minimal additional labor is needed to install the present invention on any pump currently in use.

Figure 4:
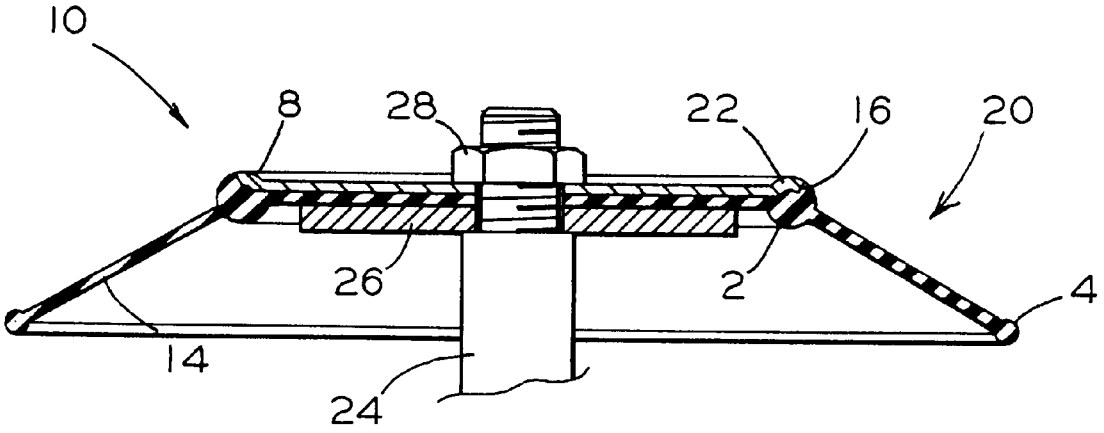
FIG. 4 is a cross-sectional view similar to that shown in FIG. 3 but also showing the relationship of the piston rod of a pump to the combination pump diaphragm and outer piston arrangement.

Reference is now made to FIG. 4. Illustrated therein is the present invention of a diaphragm and outer piston arrangement 10 and its relationship to a piston rod 24, an inner piston (flange) 26 and the nut 28 that attaches to the end of the piston rod 24 and secures the outer piston 6 and diaphragm 20 to the piston rod 24 of a pump.

Figure 5:
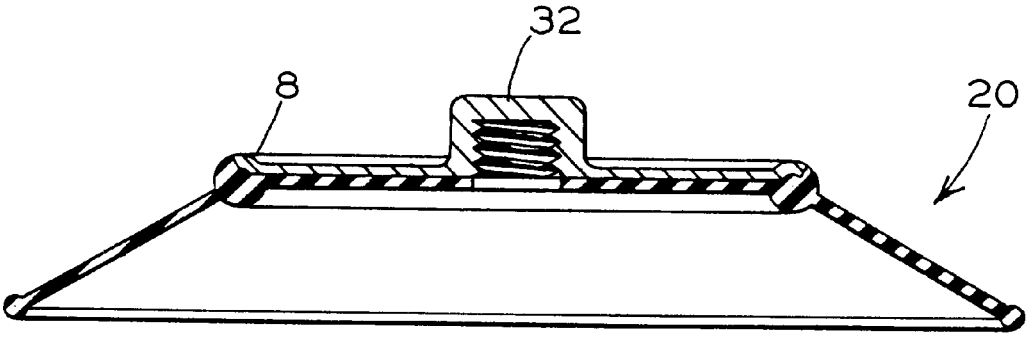
FIG. 5 is a cross sectional view of a combination pump diaphragm and outer piston arrangement showing an alternate embodiment of the invention.

Illustrated in FIG. 5 is an alternate embodiment of the invention in which outer piston member 8 has a threaded cap 32 molded to such outer piston member 8 on the side opposite the side in contact with diaphragm member 20. Such threaded cap 32 is used to replace the nut 28 seen in FIG. 4 and is designed to receive the threaded end of the piston rod 24.

While a presently preferred embodiment of the present invention has been described in detail above, it should be understood that various other adaptations and/or modifications of the invention can be made by those persons who are particularly skilled in the art related to pumping systems and more particularly diaphragms without departing from either the spirit of the invention or the scope of the amended claims.

We claim:

1. A combination pump diaphragm and outer piston arrangement used in pump applications in which at least a predetermined portion of such diaphragm is in contact with such outer piston which would tend to abrade such diaphragm, said combination pump diaphragm and outer piston arrangement comprising:

(a) a diaphragm member formed from at least one layer of a preselected flexible material, said diaphragm member including;

(i) a generally flat portion, (ii) a generally conically shaped flexure annular portion, and (iii) an enlarged bead like wear ring portion connected to an outer periphery of said generally flat portion and to a first edge portion of said generally conically shaped flexure portion, said enlarged bead like wear ring portion having a first predetermined diameter and a predetermined configuration;

(b) a means connected to a second edge portion of said generally conically shaped flexure portion of said diaphragm member for securing said second edge portion of said generally conically shaped flexure portion of said diaphragm member to a pump housing;

(c) an outer piston member engagable with said diaphragm member for securing said diaphragm member to a piston rod of a pump, said outer piston member including;

(i) a generally flat first surface portion contacting a generally flat surface portion of said generally flat portion of said diaphragm member, and (ii) an arcuate portion contacting a portion of said enlarged bead like wear ring portion of said diaphragm member such that said arcuate portion extending only far enough to contact an inner portion of said enlarged bead like wear ring;

(d) a central aperture formed in and through said generally flat portion of said diaphragm member having a second predetermined diameter; and (e) a second central aperture, having a third predetermined diameter, formed in said generally flat portion of said outer piston member substantially aligned with said central aperture of said diaphragm member for attaching said combination pump diaphragm and outer piston arrangement to such piston rod of such pump.

2. A combination pump diaphragm and outer piston arrangement for use in certain pump applications, according to claim 1, wherein said outer piston is formed from a material selected from a group consisting of metals and plastics.

3. A combination pump diaphragm and outer piston arrangement for use in certain pump applications, according to claim 2, wherein said outer piston is formed from a metal.

4. A combination pump diaphragm and outer piston arrangement for use in certain pump applications, according to claim 3, wherein said metal is aluminum.

5. A combination pump diaphragm and outer piston arrangement for use in certain pump applications, according to claim 1, wherein said preselected flexible material is selected from a group consisting of ethylene propylene diene monomers, cloroprenes, nitrile rubbers and fluoroelastomers and various mixtures thereof.

6. A combination pump diaphragm and outer piston arrangement for use in certain pump applications, according to claim 5, wherein said diaphragm further includes a fabric inner layer.

7. A combination pump diaphragm and outer piston arrangement for use in certain pump applications, according to claim 6, wherein said fabric is nylon.

8. A combination pump diaphragm and outer piston arrangement for use in certain pump applications, according to claim 1, wherein said predetermined configuration of said enlarged bead like wear ring includes a pointed projection disposed on an outer periphery of said enlarged bead like wear ring for engagement with said outer piston member.

9. A combination pump diaphragm and outer piston arrangement for use in certain pump applications, according to claim 7, wherein said predetermined configuration of said enlarged bead like wear ring includes a pointed projection disposed on an outer periphery of said enlarged bead like wear ring for engagement with said outer piston member.

10. A combination pump diaphragm and outer piston arrangement for use in certain pump applications, according to claim 1, wherein said means for securing said outer periphery of said diaphragm to such pump housing is a bead like portion having a fourth predetermined diameter.

11. A combination pump diaphragm and outer piston arrangement for use in certain pump applications, according to claim 9, wherein said means for securing said outer periphery of said diaphragm to such pump housing is a bead like portion having a fourth predetermined diameter.

12. A combination pump diaphragm and outer piston arrangement for use in certain pump applications, according to claim 1, wherein said arcuate portion of said outer piston member terminates substantially at said predetermined configuration of said enlarged bead like wear ring portion.

13. A combination pump diaphragm and outer piston arrangement for use in certain pump applications, according to claim 11, wherein said arcuate portion of said outer piston member terminates substantially at said predetermined configuration of said enlarged bead like wear ring portion.

14. A combination pump diaphragm and outer piston arrangement for use in certain pump applications, according to claim 1, wherein said generally flat portion, said generally conically shaped flexure annular portion, said enlarged bead like wear ring portion, and said means connected to said second edge portion of said generally conically shaped flexure annular portion of said diaphragm member for securing said diaphragm member to a pump housing are formed integrally as a single unit.

15. A combination pump diaphragm and outer piston arrangement for use in certain pump applications, according to claim 13, wherein said generally flat portion, said generally conically shaped flexure annular portion, said enlarged bead like wear ring portion, and said means connected to said second edge portion of said generally conically shaped flexure annular portion of said diaphragm member for securing said diaphragm member to a pump housing are formed integrally as a single unit.

16. A combination pump diaphragm and outer piston arrangement for use in certain pump applications, according to claim 9, wherein said generally flat portion, said generally conically shaped flexure annular portion, said enlarged bead like wear ring portion, said means connected to said second edge portion of said generally conically shaped flexure annular portion of said diaphragm member for securing said diaphragm member to a pump housing and said pointed projection disposed on an outer periphery of said enlarged bead like wear ring for engagement with said outer piston member are formed integrally as a single unit.

17. A combination pump diaphragm and outer piston arrangement for use in certain pump applications, according to claim 1, wherein said second predetermined diameter of said first central aperture formed in said generally flat portion of said diaphragm member and said third predetermined diameter of said second central aperture formed in said generally flat portion of said outer piston member are substantially identical.

18. A combination pump diaphragm and flange arrangement for use in certain pump applications, according to claim 15, wherein said second predetermined diameter of said first central aperture formed in said generally flat portion of said diaphragm member and said third predetermined diameter of said second central aperture formed in said generally flat portion of said outer piston member are substantially identical.

19. A combination pump diaphragm and flange arrangement for use in certain pump applications, according to claim 1, wherein a cap with interior threads for receiving a threaded end of a piston rod is molded to said outer piston member adjacent said second central aperture on a radially opposed second surface of said outer piston member.

20. A combination pump diaphragm and flange arrangement for use in certain pump applications, according to claim 18, wherein a cap with interior threads for receiving a threaded end of a piston rod is molded to said outer piston member adjacent said second central aperture on a radially opposed second surface of said outer piston member.

21. An outer piston for use in certain pump applications in which said outer piston is in contact with a pump diaphragm which would tend to abrade such diaphragm, said outer piston engagable with such diaphragm for securing such diaphragm to a piston rod of a pump, said outer piston including:

(a) a generally flat first surface portion contacting a generally flat surface portion of such diaphragm;

(b) an arcuate portion contacting a portion of an enlarged bead like portion of such diaphragm wherein said arcuate portion of said outer piston member terminates substantially at such enlarged bead like portion of such diaphragm such that said arcuate portion extending only far enough to contact an inner portion of such enlarged bead like portion; and (c) a central aperture having a predetermined diameter formed in said generally flat portion of said outer piston for attaching said outer piston to such piston rod of such pump.

22. An outer piston for use in certain pump applications, according to claim 21, wherein a cap with interior threads for receiving a threaded end of a piston rod is molded to said outer piston adjacent said central aperture on a radially opposed second surface of said outer piston member.

23. An outer piston for use in certain pump applications, according to claim 21, wherein said outer piston is formed from a material selected from a group consisting of metals and plastics.

24. An outer piston for use in certain pump applications, according to claim 23, wherein said outer piston is formed from a metal.

25. An outer piston for use in certain pump applications, according to claim 24, wherein said metal is aluminum.

26. A diaphragm used in certain pump applications in which at least a predetermined portion of said diaphragm is in contact with an outer piston which would tend to abrade such diaphragm, said diaphragm formed from at least one layer of a preselected flexible material, said diaphragm including;

(a) a generally flat portion;

(b) a generally conically shaped flexure annular portion;

(c) an enlarged bead like wear ring portion connected to an outer periphery of said generally flat portion and to a first edge portion of said generally conically shaped flexure portion, said enlarged bead like wear ring portion having a first predetermined diameter and a predetermined configuration, said predetermined configuration of said enlarged bead like wear ring includes a pointed projection disposed on an outer periphery of said enlarged bead like wear ring for engagement with such outer piston;

(d) a means connected to a second edge portion of said generally conically shaped flexure portion of said diaphragm member for securing said second edge portion of said generally conically shaped flexure portion of said diaphragm to a pump housing; and (e) a central aperture, having a second predetermined diameter, formed in said generally flat portion of said diaphragm for attaching said diaphragm to a piston rod of a pump.

27. A diaphragm used in certain pump applications, according to claim 26, wherein said preselected flexible material is selected from a group consisting of ethylene propylene diene monomers, cloroprenes, nitrile rubbers and fluoroelastomers and various mixtures thereof.

28. A diaphragm used in certain pump applications, according to claim 27, wherein said diaphragm further includes a fabric inner layer.

29. A diaphragm used in certain pump applications, according to claim 28, wherein said fabric is nylon.

30. A diaphragm used in certain pump applications, according to claim 26, wherein said means for securing said outer periphery of said diaphragm to such pump housing is a bead like portion having a predetermined diameter.

31. A diaphragm used in certain pump applications, according to claim 26, wherein said generally flat portion, said generally conically shaped flexure annular portion, said enlarged bead like wear ring portion, and said means connected to said second edge portion of said generally conically shaped flexure annular portion of said diaphragm for securing said diaphragm to a pump housing are formed integrally as a single unit.

* * * * *